United States Patent [19]

Wennerblom et al.

[11] 3,941,902

[45] Mar. 2, 1976

[54] METHOD OF MAKING SURFACE-TREATED PAPER

[75] Inventors: Bengt Axel Wennerblom, Pitea; Gustav Robert Svensson, Sundsvall, both of Sweden

[73] Assignee: Svenska Cellulosa Aktiebolaget, Sundsvall, Sweden

[22] Filed: Feb. 21, 1974

[21] Appl. No.: 444,492

[30] Foreign Application Priority Data

Mar. 2, 1973 Sweden ..... 7302960

[52] U.S. Cl. ..... 427/172; 118/410; 118/411; 162/175; 427/326; 427/395

[51] Int. Cl.[2] ..... B05C 3/02; B05D 3/02

[58] Field of Search 117/60, 111 B, 111 F, 155 UA, 117/152, 153, 156; 118/410, 411; 162/175; 427/326, 395, 172

[56] References Cited

UNITED STATES PATENTS

| | | | |
|---|---|---|---|
| 1,361,932 | 12/1920 | Van Avermaete | 118/410 |
| 2,464,771 | 3/1949 | Van Guelpen | 118/410 X |
| 2,474,691 | 6/1949 | Roehm | 118/410 |
| 2,999,787 | 9/1961 | Downs et al. | 117/60 X |
| 3,083,685 | 4/1963 | Colgan | 118/410 |
| 3,288,632 | 11/1966 | Rush et al. | 117/68 |
| 3,413,139 | 11/1968 | Rasmussen et al. | 117/65.2 X |
| 3,496,012 | 2/1970 | Biorseth | 118/410 X |
| 3,556,832 | 1/1971 | Park | 118/410 X |
| 3,672,943 | 6/1972 | Seibert | 117/68 X |

FOREIGN PATENTS OR APPLICATIONS

| | | |
|---|---|---|
| 74,898 | 12/1928 | Sweden |
| 206,396 | 12/1965 | Sweden |

*Primary Examiner*—Michael R. Lusignan
*Attorney, Agent, or Firm*—Pierce, Scheffler & Parker

[57] ABSTRACT

Surface-treated paper in the form of a continuous web is made by first roughening a base paper which serves as a starting material on the sides to be treated. The roughened web is then passed over and in direct contact with a discharge slot from a container that extends across the web and through which the desired treatment liquid is flowed onto the surface of the web, and the surface-treated paper is then dried and finally reeled.

3 Claims, 5 Drawing Figures

METHOD OF MAKING SURFACE-TREATED PAPER

METHOD OF MAKING SURFACE-TREATED PAPER

Figure 1:
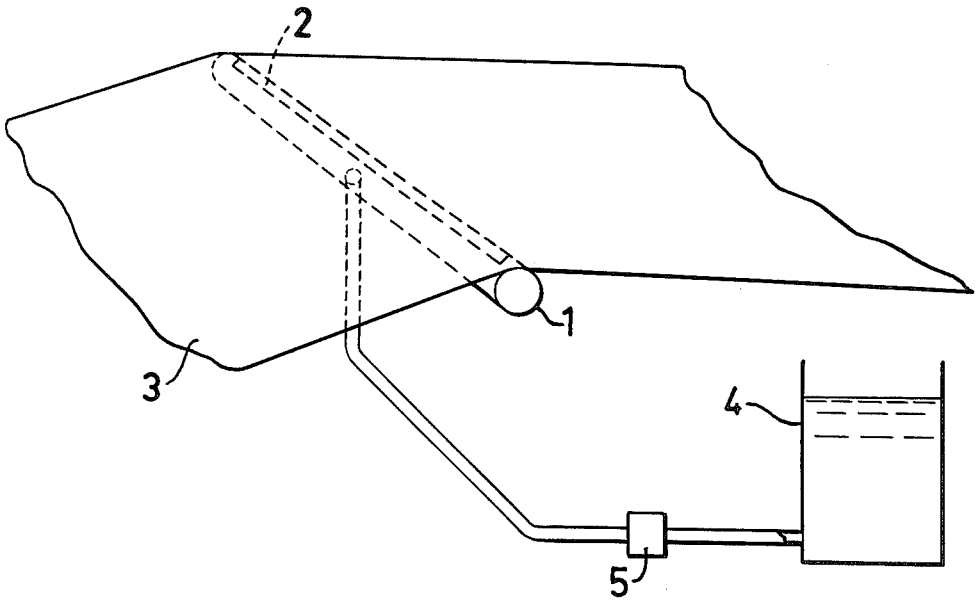

This invention relates to a method of continuously making surface-treated paper, in which method the web is provided with agents suitable for surface sizing purposes and solved or dispersed in water.

The purpose of surface sizing is to increase the bonding between the fibers, and for this purpose there are used water-soluble or water-dispersible binding agents such for instance as starch.

| Purpose | Agent | Specific term of the surface treatment |
|---|---|---|
| Increase of bonding between the fibers | Water-soluble binding agent, e.g. starch | Surface sizing |
| Increase of brightness and improvement of printability | White pigment, e.g. kaolin and binding agent, e.g. starch and synthetic polymers | Coating |
| Increase of brightness | Bleaching agent, e.g. hydrogen peroxide | Surface bleaching |
| Colouring | Colouring substance | Surface colouring |
| Increase of barrier properties and effecting heat sealing capability | Synthetic polymers, e.g. polyvinylidene chloride, in the form of aqueous dispersion | (Plastic) dispersion coat |

In surface treatments with water being the liquid phase in the treatment liquid, it is highly desirable that the amount of water, which necessarily must be applied to the paper web in order to apply the desired amount of treating agent, is as small as possible.

In other words, the concentration of treating agent should be the highest possible one. This is desirable partly because the costs for the subsequent drying thereby will be the lowest possible and partly because the treating liquid thereby will not penetrate deep into the paper. The treating agent is then concentrated on the surface layer of the paper and can thereby bring about the desired effect with a smaller amount of treating agent, i.e. in a cheaper way than if the treatment liquid penetrates deep into the paper.

The methods utilized at present for coating paper with agents having a water basis generally do not satisfy the above desire to a sufficient degree.

A well-known coating unit is called sizing press and comprises two rolls, between which the paper is passed and the liquid is simultaneously supplied to the nip. In this method, which usually is applied for surface sizing, coating and surface colouring, the amount of coating liquid applied to the paper surface usually exceeds 20 $cm^3/m^2$ per side. The amount increases with increasing coating speed, in any case when the base paper is sized, i.e. hydrophobic. In the case of unsized and absorbent base paper, the amount of liquid applied can be as high as 40 $cm^3/m^2$ and side, or higher, per the amount increases with increasing substance of the paper.

A method very usually applied for coating and dispersion coating is the so-called air-knife method, in which at first a relatively great amount of coating liquid is applied to the paper web, for example by means of a roll dipped into the liquid, and thereafter the excess is blown off by an air stream directed substantially tangentially against the paper web being moved about a roll. This method provides a highly uniformly covering coat, but the amount of liquid applied is in practice usually great, at least 20 $cm^3/m^2$. With the state of art known at present, neither the sizing press nor the air-knife method can be utilized when very high coating speeds, > 800 m/min, are desired.

A coating method rendering possible such speeds is the slide blade method, which is used for coating. Also at this method, in first an excess amount of coating liquid is applied and subsequently scraped off by means of a blade sliding angularly to the paper web whilst the paper is being moved about a roll. The amount of coating liquid applied can be reduced substantially, possibly to 7 $cm^3/m^2$ at moderate web speeds (100–200 m/min), but increasing machine speeds lessen the possibilities of applying such a small amount of liquid. Due to the resulting increase in pressure from the liquid layer against the blade, the blade is pressed outwards from the paper surface, and the amount applied increases. At high web speeds ( ≥ 500 m/min), therefore, it will be difficult in practice to come to a value below about 10 $cm^3/m^2$. The slide blade method further involves the disadvantages that the coating unit is relatively expensive, and that the coating preferably is concentrated in the cavities in the paper surface while the higher places are not covered as well.

In consideration of these problems a number of experiments have been made in order to study the possibility of supplying a paper web, which is advanced at high speed, in a better way continuously with different agents for improving or changing the surface properties of the paper. The problem, thus, has been to find some general method which renders it possible to supply a paper web by means of a simple and cheap coating unit with the treating agent, in such a manner, that the liquid applied can be substantially decreased so as a.o. to reduce the drying costs in a possible subsequent drying step.

This problem is solved according to the present invention by means of the characterizing features set forth in the claims. This is, in principle, effected thereby that the paper web to be treated at first is given a surface smoothness suitable for the treatment and thereafter is moved over and in direct contact with a slit-shaped aperture directed across the web, to which aperture the treatment liquid is continuously supplied in a uniform flow and so that the entire liquid amount is applied to the paper web.

Figure 2:
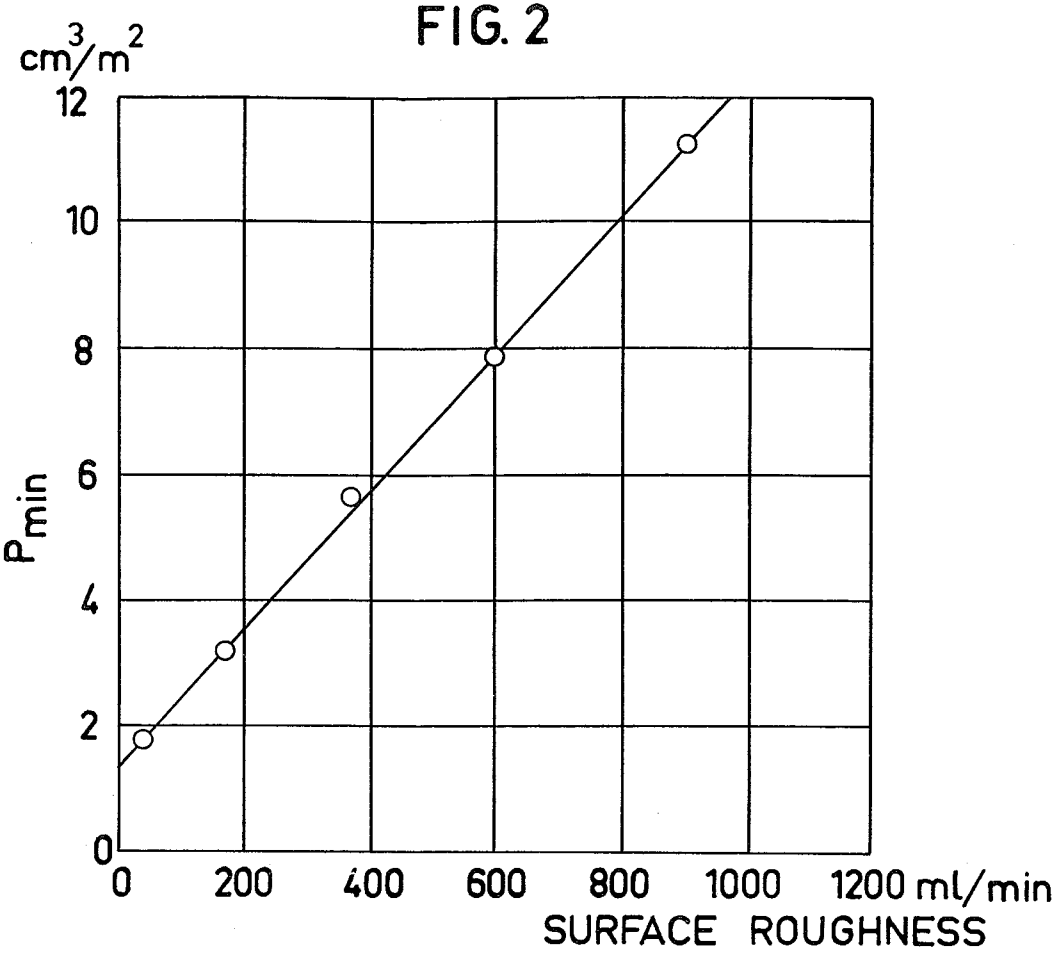
Figure 3:
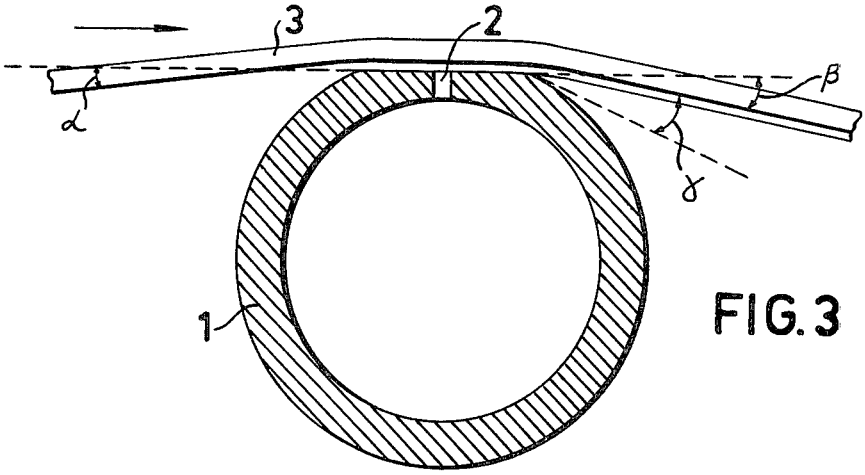
Figure 4:
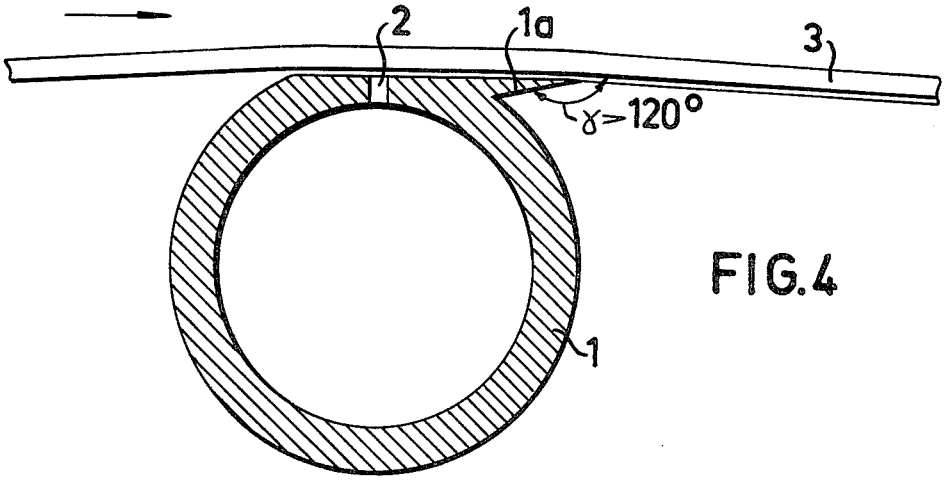
Figure 5:
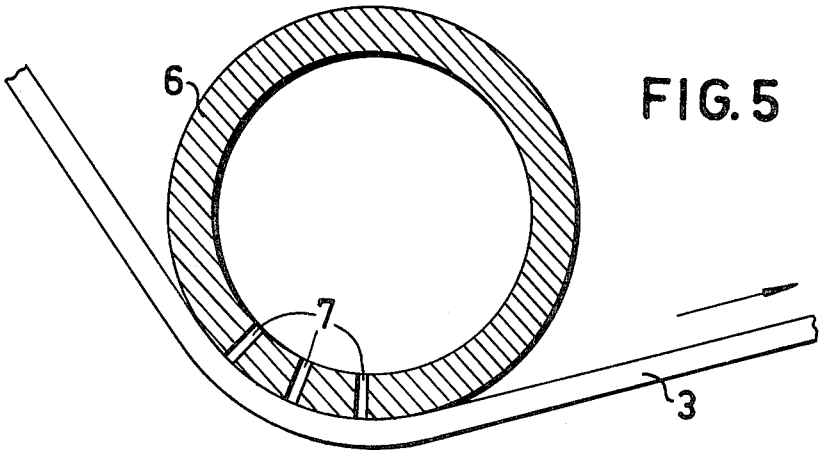

The invention is described in greater detail in the following by way of examples, with reference to the drawing, in which FIG. 1 shows a basic outline of the invention, FIG. 2 shows the smallest uniformly applicable amount of coating liquid as a function of the surface roughness, FIGS. 3 and 4 show two different embodiments of the container provided with a slit and applied by the method according to the invention, and FIG. 5 shows the principle of adjusting the tension of the paper web by means of compressed air.

In FIG. 1 is shown a basic outline of the surface treatment proper by means of a coating unit, which comprises a container 1 with a slit-shaped aperture 2, over which the paper web 3 is passed and to which treatment liquid 4 is fed by means of a pump 5. As according to the invention the entire liquid flow is to be applied to the paper web, the basic relation apparently is as follows:

$$P = \frac{q}{V \cdot b} \qquad \text{I}$$

where $P$ = amount of applied coating liquid, $cm^3/m^2$ $q$ = supplied flow of coating liquid, $cm^3/min$ $v$ = speed of paper web, m/min $b$ = length of split aperture, $m$ = coated web width, $m$ In a given concrete coating case $b$ can be regarded as a constant, and $q$ and $v$ as variable magnitudes by means of which the desired value of $P$ can be obtained.

By setting a very low value for $q$ and/or a very high value for $v$, it is possible in principle to achieve $P$-values as low as desired. In practice, however, there exists a limit for the $P$-value due to the requirement, that the coat must be uniform. Below this limit value for P, the coating liquid will be applied only here and there to the paper surface. We designate this limit value by $P_{min}$ = the smallest uniformly applicable amount of coating liquid, $cm^3/m^2$. The $P_{min}$ value being expressed here in $cm^3/m^2$ and not in $g/m^2$ is due to the fact, that determinations of $P_{min}$ for a given paper by using liquids of different density, $d$ $g/cm^3$, renders the same values when $P_{min}$ is expressed in $cm^3/m^2$ and, consequently, different values, $P_{min} \cdot d$, expressed in $g/m^2$.

In order to determine $P_{min}$ in a given concrete coating case, the procedure may, for example, be such that the flow $q$ is held constant and the highest web speed is measured at which the coating still is just uniform. When this web speed is designated by $v_{max}$ then, thus, $$P_{min} = \frac{q}{v_{max} \cdot b} \qquad \text{II}$$

$P_{min}$ can be determined also by holding the web speed v constant and measuring the smallest liquid flow at which the coating still is just uniform. When this flow is designated by $q_{min}$ then, thus, $$P_{min} = \frac{q_{min}}{v \cdot b} \qquad \text{III}$$

It was found through such tests that the surface smoothness of the paper is a decisive factor for the smallest uniformly applicable amount of liquid, $P_{min}$, and that it was possible at a sufficiently high surface smoothness to apply surprisingly small liquid amounts very uniformly, which amounts were smaller than in conventional coating methods such as, for example, sizing press, air knife or slide blade method. It was, further, found that this could be performed at surprisingly high speeds, at which the method still provided an astonishingly uniform coating as long as the $P_{min}$ value was maintained.

The surface smoothness of the paper can be measured according to several known methods. The most usual method, which was chosen here, is called the Bendtsen-method. It is described in greater detail in SCAN *P* 21 and implies, briefly, that a measuring head in the form of a metal cylinder open to one side and having an edge of extreme surface smoothness is placed on the paper surface. Thereafter air with a certain overpressure is caused to flow into the cylinder and out thereof about the paper cylinder of the contact surface. The air flow is measured. As the air flow is the higher the rougher the paper surface is, the measurement value is called surface roughness and, thus, is an inverted measure of the surface smoothness. In the measurement, the edge pressure of the cylinder against the paper surface can be as standard either 1 $kp/cm^2$ or 5 $kp/cm^2$. The surface roughness values indicated in this present application relate to measurements at 1 $kp/cm^2$.

The following experiments illustrate the effect of the surface roughness on $P_{min}$.

A newsprint paper with the substance 52 $g/m^2$ and moisture content 7.0% is used as base paper. It was made of 80% mechanical pulp and 20% chemical pulp. The surface roughness on the upper surface of the paper, which was to be surface sized later on, was 905 ml/min according to Bendtsen. From this base paper samples with varying surface roughness were prepared by calendering in 1, 2, 4 and, respectively, 8 nips. The surface roughness values for the upper surfaces of these samples were thereby 605, 370, 170 and, respectively, 40 ml/min.

The four calendered samples and the uncalendered base paper were now surface sized according to the slit-method in an experimental machine. A 2% aqueous solution of a cellulose derivative (the sodium salt of carboxymethyl cellulose (CMC), Cellufix FF 100, Svenska Cellulosa AB) was used as sizing liquid.

The smallest uniformly applicable amount of solution, $P_{min}$, was determined by maintaining the flow of sizing liquid constant and measuring the speed at which the liquid just remained uniformly applied over the paper surface. The determination was facilitated thereby that the solution was slightly coloured, owing to a small addition of a water-soluble colouring agent.

The following values of $P_{min}$ were measured

| Paper sample | Surface roughness ml/min | $P_{min}$ $cm^3/m^2$ |
|---|---|---|
| Base paper | 905 | 11.2 |
| Calendered sample 1 | 605 | 7.9 |
| Calendered sample 2 | 370 | 5.6 |
| Calendered sample 3 | 170 | 3.1 |
| Calendered sample 4 | 40 | 1.8 |

The relation between surface roughness and $P_{min}$ is illustrated in FIG. 2. The relation, as can be seen, is within the limit of errors linear and can be expressed by the equation $$P_{min} = 1.4 + 0.0107 \cdot B \qquad \text{IV}$$

where $B$ = the surface roughness according to Bendtsen, ml/min

The results show that unexpectedly small amounts of liquid can be applied uniformly even on papers with relatively rough surface.

As it is difficult to apply less than 10 $cm^3/m^2$ with the sizing methods applied at present in practice, it has been one of the objects of the present invention to be able to apply less than 10 $cm^3/m^2$ in a simple way. The results in FIG. 2 show that this is possible with the slit-method when the paper has a surface roughness below 800 ml/min.

One object of the invention has been to be able to apply water in such a small amount that the paper need not be dried after the surface treatment, but can be reeled directly. As it scarcely is realistic in practice to dry the paper prior to the surface treatment to a moisture content lower than about 5%, and as the surface treated paper in view of continued use usually cannot be permitted to have a moisture content higher than about 15%, in most cases not higher than about 10%, it is apparent that the surface treatment must not add to the paper more than 10%, preferably not more than 5% water, if this more advanced object is to be achieved.

For converting $P$ = amount of treatment liquid applied, expressed in $cm^3/m^2$, to $F$ = amount of water applied, expressed in % of absolute dry paper, the following equation can be formed $$F = \frac{P \cdot d \cdot a}{Y} = \qquad \text{V}$$

where $d$ = the density of the sizing liquid, $g/cm^3$ $a$ = water content of the coating liquid, % (weight)

$Y$ = substance of the paper, expressed as grams absolute dry paper per $m^2$

The most difficult case arises when the sizing liquid practically consists only of water, for example in surface colouring. For this case one can put $d = 1$ and $a = 100$, resulting in $$P = \frac{F \cdot Y}{100}$$

The following Table shows the values which $P$ must assume for rendering F to be 5% and, respectively, 10%, depending on the substance of the base paper.

| Substance $g/m^2$ | P-value for F = 5 | F = 10 |
|---|---|---|
| 50 | 2.5 | 5.0 |
| 100 | 5.0 | 10.0 |
| 150 | 7.5 | 15.0 |

Substances below 50 $g/m^2$ are scarcely of interest, and the most difficult case, therefore, implies the application of an amount as small as 2.5 $cm^3/m^2$. According to FIG. 2, however, even this is possible with the slit-method, namely when the surface roughness is lower than 100 ml/min.

By a combination of the equations IV and V it is possible to show more generally that the surface roughness is to be below $(9.1\ Y - 127)$, when F must be < 10% and $(4.5\ Y - 127)$, when $F$ must be < 5%.

Several methods are known of providing a paper with a certain low surface roughness. The surface roughness of the paper, for example, can be affected to a substantial degree already in the paper-making machine proper, by the choice of the fibre and filler components included, or by a series of operation conditions, such as beating degree of the fibres, fibre concentration, machine speed etc. A usual method of bringing about one side surface smooth paper, so-called MG-paper, is to subject the paper to a final drying against a large drying cylinder with high surface smoothness, a so-called Yankee-cylinder. The paper surface having abutted the cylinder shows a low surface roughness, in many cases below 100 ml/min according to Bendtsen.

When, however, a very low surface roughness on both sides is desired, special measures are taken. The methods applied are particularly such, which are based on compressing the paper in the nip between two or more rolls, and which are called smoothing or calendering. In the latter case, in addition to a compression also a sliding of the paper against one roll surface is thereby obtained that one roll in a nip is made of steel and the other roll is made of a material being more compressible, for example paper. By this method and by applying many nips, the paper can be given a high surface smoothness. It is fully possible to lower by such a so-called super-calendering the surface roughness of the paper to at least 20 ml/min according to Bendtsen.

The surface treatment proper is according to the invention to be carried out with a coating apparatus, which briefly can be called a slit unit, because it is characteristic of this unit that it comprises a slit-shaped aperture 2 in and along an oblong container 1, which is placed across the running direction of the paper web 3, and to which the sizing liquid is supplied.

The container 1 may have different shapes, but it is essential to meet the requirement of a uniform flow over the entire length of the container, i.e. over the width of the paper web.

The container 1 in its most simple design is a straight pipe. The sizing liquid can be supplied either via one end of the pipe or via one or more connections along the pipe (not shown). In the latter case a certain balancing of the liquid pressure along the pipe is obtained.

It is essential that the container abuts the paper web 3 with a uniform pressure. When the slit abuts across the machine width with a varying pressure, the sizing liquid will be applied in a non-uniform manner across the paper web width.

Although a pipe is a relatively rigid structure, it may be necessary to take special measures in order to prevent deflection of the container in cases when a wide paper web, for example of several meters width, is to be sized. The pipe can, for example, be fastened along a beam or the like. The container may also be directly designed as a structure more rigid than a pipe and, for example, have the form of a parallelepipedic box or the like.

The slit-shaped aperture 2 in the container 1 extends along the longitudinal direction of the container. The length of the aperture 2 corresponds to the width of the paper web to be sized. As no liquid must leak out outside the paper web edges, the slit aperture 2 must be at least about 1 cm shorter than the web width. The uncoated edge strips of the web may, where occurring, be cut off in connection with the reeling operation.

The slit aperture should have a width of 0.05–5 mm, preferably 0.1–2 mm. A slit aperture of a width smaller than 0.5 mm involves unnecessarily high requirements with respect to the manufacturing precision of the slit. Too wide a slit aperture, on the other hand, implies the risk of undesired absorption of liquid into the paper when it is passing the aperture. The flow resistance, furthermore, in a slit aperture having a width much too great is only insignificantly higher than the resistance in the container, in which the slit aperture is located. This in its turn implies that a possible non-uniform liquid pressure in the container across the machine width breaks through in the slit aperture and increases the risk of non-uniform liquid distribution across the web width. The slit aperture, therefore, must be so narrow that the pressure drop through the slit is across the width of the web to be sized at least three, preferably at least ten times as high as along the container.

The design of the surfaces defining the slit aperture along the outside of the container is of great importance for the function of the sizing unit. As the paper is moved over and in direct contact with these surfaces, it is primarily desirable that the surfaces consist of a wear-resistant material, particularly when the unit is intended to be used for sizing with a sizing liquid including pigment. It is further important, in view of the desired low friction resistance and good uniformity of the sizing, that the surfaces are very smooth and plane.

The angles $\alpha$ and $\beta$ formed by the paper web with the outer surfaces defining the slit aperture 2, as indicated in FIG. 2, are of importance for the process and should suitably be between 0° and 45°, preferably between 5° and 30°.

In special experiments it was, besides, surprisingly found essential for the smoothness of the application, that the paper web forms a clearance angle to the rear surface of the slit, seen in the running direction, which is not too small. This is also illustrated in FIG. 3. The angle $\alpha$ in the Figure, thus, should be at least 30°, suitably at least 90° and preferably at least 120°. This applies particularly to sizing where the clearance edge 1*a* is extended in the running direction of the paper. A preferred embodiment thereof is shown in FIG. 4.

A suitable web path of the paper over the slit unit appears from FIG. 3, which implies that the plane formed by the outer surfaces defining the slit aperture is substantially horizontal. Relatively substantial torsions, up to at maximum 90°, of the slit unit about its longitudinal axis, however, not only can be tolerated, but may at times even be desirable.

The paper web preferably should be stretched well at its passage over the slit. Experiments have shown that the web tension should exceed 50 N per m web width, preferably exceed 100 N per m web width. The upper limit, of course, is determined by the tensile strength of the web.

The paper web, however, owing to imperfections in the function of the paper-making machine, often has non-uniform properties both across and along the web. The tension in the web, therefore, is not entirely uniform across the web and can in a given position also vary with the time. In order to ensure in such cases that the slit abuts the web uniformly, it can be necessary to arrange the slit pipe so as to be easily flexible and adapted to be pressed against the paper web with a constant or substantially constant pressure. The elastic pipe is then to be suppported on a structure resistant to bending and be pressed against the paper web by means of, for example, adjustable screws, springs or hydraulic pressure.

The same effect can be achieved with a slit container resistant to bending when the tension of the paper web is controlled by sliding or rolling means, the pressure of which against the web can be adjusted over the width. This pressure can also be effected by air, for example from a stationary pipe 6 shown in FIG. 5. The pipe 6 extends across the width of the paper web 3 and is along its length and over the circumferential portion being enclosed by the paper web 3 provided with apertures 7 in the form of holes or slots, through which the air from inside the pipe 6 is forced out between the pipe and the paper web 3. Web portions with a tension lower than in the main part of the web are thereby pressed by the air father outwards from the pipe, thereby balancing the difference in pressure. This compressed air device can be placed immediately before or immediately after the nip, seen in the running direction of the paper web.

The treatment liquid applied in connection with the invention consists preferably of water as main solvent and of a treating agent dissolved or dispersed in the water.

Considering the desire of a lowest possible $P_{min}$, it was found desirable that the sizing liquid is not too highly viscous. The sizing liquid, thus, should have a viscosity of at maximum 300 cP, suitably at maximum 100 cP and preferably at maximum 50 cP, measured with Brookfield viscosimeter at 50 rpm.

It is highly essential for the method according to the invention, that the treatment liquid is supplied at a constant flow to the coating unit, as otherwise the application will not be uniform. For this purpose, the liquid should be supplied by a pump 5 delivering a flow free from pulsations. Suitable pumps are, for example, screw pumps or geated pumps. Such pumps can also be utilized as control means as their setting to a known and constant flow value, which also is essential for the method according to the invention, can take place simply by means of the number of revolutions. The flow delivered by a screw or geared pump, besides, is relatively independent of the counterpressure of the liquid, which is a great advantage.

The flow, $q$ cm³/min, to which the pump is to be adjusted, is determined by the desired treatment width $b$ m, desired amount of treatment liquid applied $P$ cm³/m², and the paper web speed v m/min. By converting equation I one obtains $$q = P \cdot v \cdot b \qquad \text{VII}$$

As in a given coating case $P$ and $b$ are constants, $q$ is dependent only on $v$ $$q = \text{const} \cdot v \qquad \text{VIII}$$

This leads to the conclusion that the pump very suitably is connected to the same drive means as the coating machine so that a change in the machine speed directly brings about a corresponding relative change in the number of revolutions of the pump, and thereby of the flow. The same effect, of course, can be achieved by means of a non-volumetric pump, for example a centrifugal pump, the flow of which is adjusted by a control means with impulse from the machine speed.

One of the most essential characterizing features of the invention is that the entire liquid flow from the slit aperture is applied to the paper web and, thus, no overflow or recirculation of the sizing liquid occurs. The invention neither intends such a utilization of the slit unit that the unit shall apply more than the desired final amount of sizing liquid and that thereafter the excess is to be scraped off, for example by blade or stave.

The essential advantages of the invention that the amount of liquid applied can simply and safely be controlled and adjusted according to the equations VII and VIII and associated text, can be achieved only by applying the entire liquid flow to the paper web, without overflow or return flow.

The invention can be applied to a plurality of different treatment cases, some of which are described in greater detail and explained by examples in the following.

SURFACE SIZING

Surface sizing relates to a process of supplying an aqueous solution of binding agent to the paper surface.

The object of surface sizing usually is to improve the bonding between the fibres in the surface layer of the paper, but often the objects may be different ones, for example to reduce the porosity of the surface. Both said stated effects are of importance when using the paper, particularly for printing. The improved bond between the fibres, thus, results in a reduced risk of picking and dusting. The reduced porosity results in a reduced penetration of liquid phase of the ink, which in its turn provides a print quality improved in several respects.

The picking and dusting risk in printing is particularly great in offset printing, which involves the use of water on the printing roller and of highly viscous inks. The dusting problem has become of interest particularly in connection with the change from letter-press to offset printing of newspapers.

The binding agents, which may be used for surface sizing, usually are cheap water-soluble polymers, such as starch, cellulose ethers, for example the sodium salt of carboxymethyl cellulose (CMC), polyvinyl alcohol.

The surface sizing method which, without comparision, is the most usual one is a sizing press installed in the drying section of the papermaking machine. The method is simple, but has several disadvantages. The greatest disadvantage is the high amount of binding agent solution (surface size) which requires a substantial afterdrying. It is, furthermore, difficult to control the amount of surface size applied, which amount is highly dependent on the absorption properties of the paper, the viscosity of the surface size and the machine speed. In order to obtain a low amount of binding agent applied, which is desirable from an economic point of view, one is forced to use a low binding agent concentration.

Instead of surface sizing one may, with the slit-method according to the present invention, increase the binding agent concentration by applying correspondingly less surface size. This will also result in much less water to be dried off.

EXAMPLE 1*a*

In this experiment a newsprint paper from a modern high-speed machine was used. The paper had a substance of 52 g/m$^2$ and was made of 80% mechanical pulp and 20% chemical pulp. The samples, which were surface sized, were taken uncalendered from the machine. The surface roughness was 560 ml/min on the upper side and 595 ml/min on the wire side of the paper, determined according to Bendtsen. The bulk was 2.29 cm$^3$/g. The moisture content was 7.0%.

As binding agent at the surface sizing a low viscous CMC quality Cellufix FF-100 with a concentration of 1.4% was used. The viscosity of this solution was 44 cP, measured with Brookfield viscosimeter at 50 rpm and 20°C.

The surface sizing was carried out in a half-scale machine where the paper at first was coated on the wire side and thereafter on the upper side. The coated paper was dried with hot air whereafter the opposite side was coated and dried in the same manner.

The solution at room temperature was supplied continuously to the slit with a capacity of 60 cm$^3$/min. The machine speed was so adjusted that a uniform covering of the entire paper web was obtained. The speed was thereby 27–28.5 m/min. The amount applied was 7.5 cm$^3$/m$^2$ on the upper side and 8.0 cm$^3$/m$^2$ on the wire side, as the web width was 28 cm. This corresponds to 0.105 and, respectively, 0.112 g bone-dry binding agent per m$^2$.

The surface sized sample as well as the untreated paper were smoothed prior to the evaluation of different propeties. This evaluation was carried out in a half-scale calender where the paper had to pass two roller nips at 20°C. The nip pressure was adjusted so that the bulk after smoothing was 1.40 cm$^3$ /g, which is a normal bulk for commercially smoothed newsprint paper.

The smoothed samples were tested with respect to a plurality of properties according to methods usually applied in the trade. As regards the dusting tendency, which is particularly important in this conjunction, the following testing method was used:

TESTING METHOD FOR DETERMINATION OF DUSTING AT OFFSETPRINT PAPER

In this method a Multilith 1250 sheet offset printing press was used. The paper to be tested was cut to A4 sheets. For each test 100 sheets are used. For double testing of the upper and wire side, thus, at least 400 A4 sheets are required. The running direction of the paper at its making was determined by tape abrasion. The sheet stacks were carefully shaken and turned over in order to remove possible cutting dust.

In the Multilith press the dampening device and the inking device were disconnected for holding the number of sheets per test low. The printing pressure was held as high as permissible with respect to a trouble-free feed of the sheets, and the press speed was set at about 70 sheets/min.

On the cleaned rubber cloth ten remission values uniformly distributed over the cloth are measured with an Elrepho FMY/C filter. The cloth is thereafter mounted, and 100 sheets are passed through the press nip. The rubber cloth is removed, and the remission on the cloth is again measured, this time with twenty values distributed over the cloth.

The difference between the remission values of the cloth before and after the test is called $\Delta R$.

The dusting value $\Delta Ry$ is obtained by multiplying the value $\Delta R$ with the correction factor for the cloth wear, which is determined by tests with standard paper.

The results given in the Table below show that the dusting tendency could be lowered to a third by sizing, without appreciably affecting other printing-technical properties.

Thus, no negative effects of the surface treatment were observed. This result is surprising, because experts consider it very difficult to improve the dusting properties without at the same time deteriorating printing properties.

TABLE I

| | | Untreated paper | Surface sized paper |
|---|---|---|---|
| Applied amount wet $cm^3/m^2$ | upper s. | | 7.5 |
| " | wire s. | | 8.0 |
| Applied amount dry $g/m^2$ | upper s. | | 0.105 |
| " | wire s. | | 0.112 |
| Surface roughness, Parker Print $\mu m$ | | | |
| | upper s. | 2.91 | 2.69 |
| | wire s. | 2.85 | 2.61 |
| Print-through at blackness contrast 0,85 $g/m^2$ | | | |
| | upper s. | 4.4 | 4.5 |
| | wire s. | 4.2 | 4.7 |
| Ink demand at blackness contrast 0,85 $g/m^2$ | | | |
| | upper s. | 1.64 | 1.52 |
| | wire s. | 1.53 | 1.57 |
| Ink transfer % | upper s. | 55.7 | 52.6 |
| | wire s. | 56.3 | 56.3 |
| Covering power s W | upper s. | 3.07 | 2.90 |
| | wire s. | 3.05 | 2.93 |
| Print opacity | | 0.953 | 0.949 |
| Set off | upper s. | 27.0 | 26.3 |
| | wire s. | 27.0 | 28.9 |
| Rub off | upper s. | | 9.6 |
| | wire s. | | 11.1 |
| Dusting test ΔRy | upper s. | 0.33 | 0.10 |
| | wire s. | 0.44 | 0.14 |

EXAMPLE 1*b*

A surface sizing experiment was carried out at a higher machine speed. A periodical-print paper with the substance 60 $g/m^2$ was used at this experiment. The paper was made of 22% chemical pulp and 78% groundwood pulp. The surface roughness of the upper side was 185 ml/min determined according to Bendtsen. The moisture content was 7.6%.

As binding agent at the surface sizing a low viscous CMC quality, Cellufix FF-100, with a concentration of 1.4% was used. The viscosity of this solution was 44 cP measured with Brookfield viscosimeter at 50 rpm. A small amount of colorants (0.04 Rhodamin B 200) was added to the surface size in order to be able to judge the uniformity of the coating.

The surface sizing was carried out in a high-speed machine where the upper side of the paper was coated. The solution of room temperature was supplied continuously to the slit with such a flow that at the machine speed of 450 m/min the paper web was covered uniformly. The applied amount was 4.0 $m^3/m^2$.

The uniformity of the coat was very good.

EXAMPLE 2

SURFACE COLOURING

Coloured paper is in most cases still made by adding colouring agents to the stock, but surface colouring becomes increasingly more usual. Surface colouring has great advantages over stock colouring. Surface colouring does not require as much of colouring agent as stock colouring for a given desired colouring effect at the same time as a number of problems arising in stock colouring are avoided. The colouring agent is at stock colouring not retained to 100% in the paper, but part of it is found in the backwater where it gives rise to difficulties when the production is changed from making coloured paper to making non-coloured paper, and it can also provide serious environment problems.

In many cases it is sufficient, or even desirable, to colour only one side of the paper. In such cases the only method to be used is surface colouring.

Most of the known surface coating methods can, of course, also be used for surface colouring, but the slit-method according to the invention, in the fashion disclosed in the present application, has a number of great advantages. It renders possible a very simple and uniform application of colouring agent solution even at very high speeds. It is, further, possible to control and adjust in a very simple and efficient way the amount of colouring agent applied. Furthermore, it is very easy to start and to end the colouring by switching in and off the pump which feeds the colouring solution to the slit aperture.

Still another essential advantage with the method according to the invention when being applied to surface colouring is that it is thereby possible to apply so little of colouring solution that the after-drying can be made very simple, for example by means of some infrared elements, or the after-drying may even be abolished. This latter possibility applies particularly to one side surface colouring.

EXAMPLE 2*a*

Two experiments with two side surface colouring were carried out. The base papers used at the experiments were two periodical-print papers with the data as follows:

| Paper data | | Ex. 2A | Ex. 2B |
|---|---|---|---|
| Substance | $g/m^2$ | 51 | 67 |
| Fiber composition: | % mechanical wood-pulp | 85 | 87 |
| | % chemical pulp | 15 | 13 |
| Ash content | % | 7 | 12 |
| Moisture content | % | 6.8 | 7.2 |

-continued

| Paper data | Ex. 2A | Ex. 2B |
|---|---|---|
| Surface roughness,Bendtsen ml/min | 230 | 500 |

As colouring agent fluid basic colouring agents from BASF were used. The colouring solutions were prepared by mixing the fluid colouring agent with water.

For preparing a special yellow and a special green colour tone, the following colouring agent combinations were used:

| Colouring agent | | Ex 2A | Ex 2B |
|---|---|---|---|
| Auramin fluid conc. | % | 0.05 | 0.04 |
| Chrysoidine | % | 0.10 | |
| Burma green | % | | 0.04 |

The surface colouring was carried out in a half-scale machine, in which the paper at first was treated on the wire side and then on the upper side. The solution at room temperature was supplied continuously to the slit. The machine speed was set so that the amount applied exceeded with a good margin $P_{min}$ in order to obtain a deposit being equally large on the wire and on the upper side, and thereby also to obtain the same colour intensity on both sides.

The amount applied was in this experiment 10.0 $cm^3$ on the respective side. The treated paper was dried with hot air. In both experiments the papers became coloured very uniformly.

EXAMPLE 2*b*

For experiments with one side surface colouring without subsequent drying, a super-calendered paper with the substance 55 $g/m^2$ was used, which was made of 25% chemical pulp and 75% mechanical woodpulp. The ash content of the paper was 10% and the moisture content 6.3%. The surface roughness of the upper side was 50 ml/min according to Bendtsen.

As colouring agent fluid basic colouring agents from BASF were used. The colouring solution was prepared by mixing 2.6% Auramin fluid conc. and 0.1% Burma green with water.

The surface colouring was carried out in a high-speed machine. The paper was treated on the upper side. The solution at room temperature was supplied continuously to the slit, and the flow was so adjusted that the amount applied was immediately above $P_{min}$. The machine speed was 170 m/min. The amount of colouring solution applied was 3.7 $cm^3/m^2$. The coloured paper was reeled without drying. The moisture content in the base paper was 6.3%, and after colouring and reeling 10.1%. The calculated moisture content after the colouring is 13.0%. The moisture content in the paper, thus, is reduced by 2.9% in the passage between slit and reeling, due to natural evaporation.

The paper was coloured very uniformly and could be used in its prevailing state, without further drying. It was adapted, for example, to be used for placards.

The invention provides the same aforementioned advantages in principle in a plurality of additional application cases. Such cases include a.o. treating with aqueous dispersions or emulsions of natural or synthetic polymers for bringing about special effects, such as hydrophobicity, heat sealing capability, gastightness, watertightness, oiltightness, etc. By utilizing the possibility according to the invention of uniformly applying a desired polymer with a minimum amount of accompanying water, a desired value of a certain effect is achieved with a minimum amount of polymer, and thereby at minimum costs, at the same time as the drying costs are reduced.

Further great advantages of the slit-method are that the treating unit is cheap and requires little space.

We claim:

1. Method of surface sizing paper in the form of a continuous web, which consists essentially of passing the web over and in direct contact with a slot-shaped aperture in a container, which aperture is co-extensive with the width of the web, while continuously introducing into the container and exiting the same via the slot thereof a sizing material consisting essentially in an aqueous suspension of a sizing agent, continuously transferring the so-exiting sizing material without pulsations and without any excess, to the web passing said web over the surfaces adjacent the aperture at an angle of from 0° to 45° while under a controlled tension of at least 50 newton, said sizing material being introduced into said container at such a rate that the sizing material is applied to the paper web in an amount of at least $(1.4 + 0.0107.B)cm^3$ per $m^2$ of the paper web, where $B$ = the surface roughness of the web measured according to Bendsten, and drying and reeling the so-sized paper web dried and finally reeled.

2. A method as defined in claim 1, wherein the web in exiting from the aperture forms a clearance angle of at least 30°, preferably of at least 120° with the outside of the container.

3. A method as defined in claim 1, wherein possible local differences in the web tension of the paper are balanced by means of compressed air acting from nozzles distributed across and thereagainst the web.

* * * * *